US007116344B2

(12) United States Patent
Shimoda

(10) Patent No.: US 7,116,344 B2
(45) Date of Patent: Oct. 3, 2006

(54) HANDY THERMAL HEAD PRINTER

(75) Inventor: Yuji Shimoda, Tokyo (JP)

(73) Assignees: Fujitsu Limited, Kawasaki (JP); Fujitsu Frontech Limited, Inagi (JP)

( * ) Notice: Subject to any disclaimer, the term of this patent is extended or adjusted under 35 U.S.C. 154(b) by 551 days.

(21) Appl. No.: 10/670,382

(22) Filed: Sep. 26, 2003

(65) Prior Publication Data

US 2004/0070662 A1 Apr. 15, 2004

(30) Foreign Application Priority Data

Sep. 30, 2002 (JP) ..... 2002-287782

(51) Int. Cl.
*B41J 29/00* (2006.01)

(52) U.S. Cl. ..... 347/222; 400/691

(58) Field of Classification Search ..... 347/222; 400/691, 693, 594

See application file for complete search history.

(56) References Cited

U.S. PATENT DOCUMENTS

| | | | | |
|---|---|---|---|---|
| 5,110,226 A * | 5/1992 | Sherman et al. | ..... | 400/88 |
| 5,201,588 A * | 4/1993 | Sakai et al. | ..... | 400/613 |
| 5,396,396 A | 3/1995 | Watanabe | ..... | 361/212 |
| 5,411,342 A * | 5/1995 | Horie et al. | ..... | 400/613 |
| 5,486,062 A * | 1/1996 | Tsurumaru | ..... | 400/618 |
| 6,181,361 B1 * | 1/2001 | Bluteau et al. | ..... | 347/222 |

FOREIGN PATENT DOCUMENTS

| | | |
|---|---|---|
| EP | 0 628 925 A2 | 12/1994 |
| JP | 9-1901 | 1/1997 |
| JP | 2000-338822 | 12/2000 |
| JP | 2001-277680 | 10/2001 |
| JP | 2002-123151 | 4/2002 |

* cited by examiner

*Primary Examiner*—Huan Tran
(74) *Attorney, Agent, or Firm*—Armstrong, Kratz, Quintos, Hanson & Brooks, LLP

(57) ABSTRACT

A printer has a main body and a printer unit that is fixed to the main body. The printer unit has an upper cover and a lower cover. The lower cover is attached to the main body and the upper cover is fixed to the lower cover. A hollow space is formed between the upper and lower covers and a printing paper is set in this space. A sensor is provided in the upper cover and it detects a mark on the non-printable surface of the printing paper. One protrusion is provided in each of the upper and lower covers such that the protrusions make an electrical contact when the upper and lower covers are closed. A control unit is provided in the main body and it is electrically connected to the mark detection unit through the protrusions on the upper and lower covers and it controls various operations of the printer.

13 Claims, 9 Drawing Sheets

HANDY THERMAL HEAD PRINTER

BACKGROUND OF THE INVENTION

1) Field of the Invention

The present invention relates to a handy thermal head printer.

2) Description of the Related Art

FIG. 7 is a partially cut perspective view of a conventional printer 10. The printer 10 is handheld by a user and has the function of printing electricity bills, product sales information or the like. This printer 10 has a main body 11 that houses a printer substrate (not shown). This printer substrate holds a control unit (not shown) that controls the printing process.

The main body 11 has a clam-type printer unit 12 provided at one end 11*a* thereof. The printer unit 12 has a lower cover 13 and an upper cover 14. The lower cover 13 and the upper cover 14 are joined at a joint 15 so that the upper cover 14 can be freely opened and closed. As shown in FIG. 8, which is a cross sectional view of the printer 10 along the line A–A' shown in FIG. 7, a roll paper R1 is loaded in the hollow space between the lower cover 13 and the upper cover 14, when the lower cover 13 and the upper cover 14 are closed. The roll paper R1 is ribbon-shaped thermal paper and it is wound around a shaft.

Marks are printed beforehand at predetermined intervals near at least one of the longitudinal borders of the roll paper R1 on the printable surface. The marks correspond to the positions where printing is to be started (hereinafter "printing start position") and where printing is to be stopped (hereinafter "printing end position"). From hereon, the printable surface of the roll paper R1 is the front surface on which information is printed and a non-printable surface is the backside of the roller paper R1 on which information is not printed.

As shown in FIG. 7, the upper cover 14 has a platen roller 16 provided at an end 14*a* thereof. This platen roller 16 can rotate freely. The main body 11 also has a thermal head 18 provided at the end 11*a* thereof. This thermal head 18 faces the platen roller 16. During printing, the platen roller 16 sequentially transfers the roll paper R1, held between a thermal head 18, for a distance equivalent to one line. The platen roller 16 is driven by a motor (not shown) by means of a gear (not shown).

The main body 11 further has a mark detecting sensor 17 provided at the end 11*a* thereof. The mark detecting sensor 17 consists of a light emitting element and a light receiving element. The mark detecting sensor 17 serves to detect the presence of the marks on the printable surface of the roll paper R1.

More specifically, an infrared light or the like is irradiated from the light emitting element towards the printable surface. The mark detecting sensor 17 detects the marks based on the amount of light received by the light receiving element. The mark detecting sensor 17 is connected to a control unit (not shown).

As shown in FIG. 8, when the upper cover 13 is closed, the thermal head 18 is pressed against the platen roller 16 with the roll paper R1 sandwiched therebetween. The thermal head 18 has a number of heating elements placed along its length. These heating elements print dots in one line on the roll paper R1. The thermal head 18 prints the data in the form of dots on the printable surface of the roll paper R1 by applying heat to the roll paper R1.

The roll paper R1 is set in the conventional printer 10 with the following procedure. The person (hereinafter "user") who is loading the roll paper upper cover 14 opens upper cover 14 and loads the roll paper R1 in the hollow space between the lower cover 13 and the upper cover 14.

Then the user passes the end of the roll paper R1 through the lower cover 13, a guide area 13*a*, and a mark detecting sensor 17 and, pulls the end till the thermal head 18. Then the user closes the upper cover 14. In this state, the platen roller 16 is pressed against the thermal head 18 with the roll paper R1 sandwiched therebetween, and the end of the roll paper R1 protrudes beyond an opening (hereinafter "ejection") 19 from where the roll paper R1 is ejected out.

When printing, the control unit drives the motor and rotates the platen roller 16 for a distance equivalent to one line. As a result, the roll paper R1, of length equivalent to one line, is sequentially ejected from the ejection 19.

When the marker detection sensor 17 detects a mark on the printable surface of the roll paper R1, it informs (i.e., sends a signal to) the control unit of the detection of the mark. The control unit identifies the position of the mark as the printing start position and instructs the thermal head 18 to print data on the printable surface of the roll paper R1 in an area other than the area (hereinafter "non-printable area") of the roll paper R1 from the border to where the marks are printed.

When the mark detecting sensor 17 detects the next mark, it informs the control unit of the detection of the mark. The control unit identifies the position of the mark as the printing end position and stops the motor to thereby stop the rotation of the platen roller 16. In this manner, data is printed between the marks on the printable surface of the roll paper R1.

However, as marks are printed beforehand on the printable surface of the roll paper R1, the non-printable area can not be used for printing. In other words, in this conventional printer 10 there is a problem in that the area where printing can be done is restricted to the area other than the non-printable area.

FIG. 9 shows another conventional printer 20 that solves the problems in the conventional printer 10. FIG. 9 is a partially cut perspective view of the external configuration of the conventional printer 20.

The printer 20 has a main body 21 that houses a print substrate (not shown). This print substrate further holds a control unit (not shown) that controls the printing process.

The main body 21 has a clam-type printer unit 22 provided at one end 21*a* thereof. The printer unit 22 has a lower cover 23 and an upper cover 25. The lower cover 23 and the upper cover 25 are joined at a joint 24 so that the upper cover 25 can be freely opened and closed.

As shown in FIG. 10, which is a cross sectional view of FIG. 9 along the line B–B', a roll paper R2 is loaded in the space between the lower cover 23 and the upper cover 25, when the lower cover 23 and the upper cover 25 are closed. The roll paper R3 is ribbon-shaped thermal paper and it is wound around a shaft.

Marks are printed beforehand at predetermined intervals near at least one of the longitudinal borders of the roll paper R2 on the non-printable surface. Similar to the roll paper R1 shown in FIG. 8, these marks correspond to the printing start position and the printing end position.

The main body 21 has a platen roller 26 provided at the end 21*a* thereof, such that the platen roller 26 can rotate freely. As shown in FIG. 10, the platen roller 26 serves to transfer the roll paper R2 that is held between the thermal head 18, along a single line.

The platen roller 26 is driven by a motor (not shown) by means of a gear (not shown). A knob 27 is provided to one end of the platen roller 26 and this knob 27 is used for manually rotating the platen roller 26.

As shown in FIG. 10, the main body 21 has a mark detecting sensor 28 provided at the end 21*a* thereof, such that the mark detecting sensor 28 is located near the platen roller 26. The mark detecting sensor 28 detects the presence of the marks on the non-printable surface of the roll paper R2. The mark detecting sensor 28 is connected to the control unit (not shown).

The main body 21 further has a thermal head 29 near the platen roller 26. When the upper cover 25 is closed over the lower cover 23 and the roll paper R2 is loaded in the space therebetween, the thermal head 29 presses against the platen roller 26 with the roll paper R2 sandwiched therebetween. The thermal head 29 has a number of heating elements placed along its length. These heating elements print dots in one line on the roll paper R2. The thermal head 29 prints data in the form of dots on the printable surface of the roll paper R2 by applying heat to the roll paper R2.

In comparison with the printer 10 shown in FIG. 8, in the printer 20, it is possible to increase the printable area of the roll paper R2, as the marks are printed on the non-printable surface, and not on the printable surface.

The roll paper R2 is set in the conventional printer 20 with the following procedure. The user opens the upper cover 25 and loads the roll paper R2 in the hollow space between the lower cover 23 and the upper cover 25.

Then the user passes the end of the roll paper R2 through the lower cover 23, a guide screen 23*a*, and the mark detecting sensor 28 and pulls the end of the roll paper 20 till the roll paper R2 is sandwiched between the platen roller 26 and the thermal head 29.

Then the user rotates the knob 27 such that the roll paper R2 is transferred in the direction of the ejection 19.

When printing, the control unit drives the motor and thereby rotates the platen roller 26 for a distance equivalent to a line. As a result, the roll paper R2, of length equivalent to one line, is sequentially ejected from the ejection 19.

When the mark detecting sensor 28 detects a mark on the non-printable surface of the roll paper R2, it informs the control unit of the detection of the mark. The control unit identifies the position of the mark as printing start position and instructs the thermal head 29 to print data on the printable surface of the roll paper R2.

When the mark detecting sensor 28 detects the next mark, it informs the control unit of the detection of the mark. The control unit identifies the position of the mark as printing end position and stops the motor to thereby stop the rotation of the platen roller 26. In this manner, the data is printed on the printable surface of the roll paper R2.

However, in the conventional printer 20, as the platen roller 26 is provided at the end 21*a*, in comparison with the printer 10, there is a difficulty in loading the roll paper R2.

FIG. 11 shows another conventional printer 40 that solves the problems that were there in the conventional printers 10 and 20. In this printer 40, a roll paper that has the mark printed on the non-printable surface is used, moreover, the platen roller is arranged near the upper cover. FIG. 11 shows a cross sectional view of the printer 40.

The printer 40 has a main body 41 that houses a print substrate (not shown). This print substrate further holds a control unit (not shown) that controls the printing process.

The main body 41 has a clam-type printer unit 42 that has a lower outer cover 43 and an upper outer cover 44. The lower outer cover 43 and the upper outer cover 44 are connected by a joint 52 such that the upper outer cover 44 can be freely opened and closed.

A lower inner cover 45 and an upper inner cover 46 are provided on the inside of the lower outer cover 43 and the upper outer cover 44, respectively.

A roll paper R3 is loaded in the space between the lower outer cover 43 and the upper outer cover 44. The roll paper R3 is ribbon-shaped and it is wound around a shaft. One end of the roll paper R3 is R3*a*, the printable surface is R3*b* and the non-printable surface is R3*c*.

Marks are printed beforehand at predetermined interval near at least one of the longitudinal borders of the roll paper R3 on the non-printable surface R3*c*. These marks correspond to the printing start position and the printing end position.

The upper outer cover 44 is provided with a platen roller 49 attached to an end 44*a* thereof, such that the platen roller 49 can rotate freely. During the printing process, the platen roller 49 sequentially transfers the roll paper R3 that is held between the thermal head 51 for a length equivalent to one line. The platen roller 49 is driven by a motor (not shown) by means of a gear (not shown).

The upper outer cover 44 is provided with a mark detecting sensor 50 attached to the end 44*a* thereof, such that the mark detecting sensor 50 is located near the platen roller 49. The mark detecting sensor 50 detects the marks on the non-printable surface R3*c*. The mark detecting sensor 50 is connected to the control unit (not shown) through a cable 47. The cable 47 is placed in a space between the lower inner cover 45 and the upper inner cover 46.

The main body is provided with a thermal head 51 that faces the platen roller 49. When the lower outer cover 43 and the upper outer cover 44 are closed, the thermal head 51 presses against the platen roller 49 with the roll paper R3 sandwiched therebetween. The thermal head 51 has a number of heating elements placed along its length. These heating elements print dots in one line on the roll paper R3. The thermal head 51 prints data in the form of dots on the printable surface R3*b* of the roll paper R3 by applying heat to the roll paper R3.

The roll paper R3 is set in the conventional printer 40 with the following procedure. The user opens the covers 43, 44, 45, and 46 and loads the roll paper R3 in the hollow space between the lower outer cover 43 and the lower inner cover 45.

Then the user passes the end R3*a* of the roll paper R3 through the lower inner cover 45 and the mark detecting sensor 50 and pulls the end till the thermal head 51. Then the user closes the upper inner cover 46 and the upper outer cover 44. In this state, the platen roller 49 presses against the thermal head 51 with the roll paper R3 sandwiched therebetween and end R3*a* of the roll paper R3 protrudes beyond an opening from where the roll paper R3 is ejected out.

When printing, the control unit drives the motor and rotates the platen roller 49 for a distance equivalent to one line. As a result, the roll paper R3, of length equivalent to one line, is sequentially ejected.

When the mark detecting sensor 50 detects a mark on the non-printable surface R3*c*, it informs the control unit of the detection of the mark. The control unit identifies the position of the mark as the printing start position and instructs the thermal head 51 to print data on the printable surface R3*b* of the roll paper R3.

When the mark detecting sensor 50 detects the next mark, it informs the control unit of the detection of the mark. The control unit identifies the position of the mark as the printing end position and stops the motor to thereby stop the rotation of the platen roller 49. In this manner, data is printed on the printable surface R3*b* of the roll paper R3.

The Japanese Patent Laid-Open Publications 2000-338822 and 2002-123151 disclose other conventional printers.

In the printer 40 shown in FIG. 11, the upper outer cover 44 is provided with the platen roller 49 and the mark detecting sensor 50 attached at the end 44*a* thereof. As a result, in comparison with the printer 20, the printer 40 has a merit that the roll paper can be loaded easily. Moreover, the conventional printer 40 uses a roll paper that has the marks printed on the non-printable surface thereof. As a result, in comparison with the printer 20, the printer 40 has a merit that the printable area can be increased.

However, in the printer 40, since the mark detecting sensor 50 is located at the end 44*a* of the upper outer cover 44, the cable 47 has to be wired in a space between the inner surface and the outer surface of the printer 42. As a result in the printer 40, the printer unit 42 has to be made a twofold structure to accommodate the cable 47 and, therefore, the cost increases.

In addition, the printer unit 42 and the main body 41 are configured as a single unit. Therefore, if the printer unit 42 drops from the hand of the user, the entire unit is damaged. Hence, there is a problem that high cost is incurred as the entire unit must be replaced in case of damage.

Further, the cable 47 bends when the printer unit 42 is repeatedly opened and closed, often causing the breakage of the cable 47. Hence the printer becomes less reliable due to damage of the cable 47.

SUMMARY OF THE INVENTION

It is one of the objects of the present invention to provide a printer that is cost effective and highly reliable.

The printer according to one aspect of present invention has a main body and a printer unit that is fixed to the main body. The printer unit has a first cover and a second cover. The second cover is attached to the main body. The first cover is fixed to the second cover with a hinge such that the first cover rotates freely along the hinge. A hollow space is formed between the first cover and the second cover when the first cover is closed against the second cover. A printing paper having a printable surface and a non-printable surface is loaded in this hollow space. The non-printable surface of the printing paper has at least one mark. The printer also has a mark detecting unit provided in the first cover and that detects the mark on the non-printable surface of the printing paper, a first contact member provided in the first cover, a second contact member provided in the second cover that makes a physical contact with the first contact member when the first cover is closed over the second cover, and a control unit provided in the main body that is electrically connected to the mark detection unit through the first and the second contact members and that controls various operations of the printer.

These and other objects, features and advantages of the present invention are specifically set forth in or will become apparent from the following detailed descriptions of the invention when read in conjunction with the accompanying drawings.

DETAILED DESCRIPTIONS

An exemplary embodiment of the printer according to the present invention is explained in detail with reference to the accompanying drawings.

Figure 1:
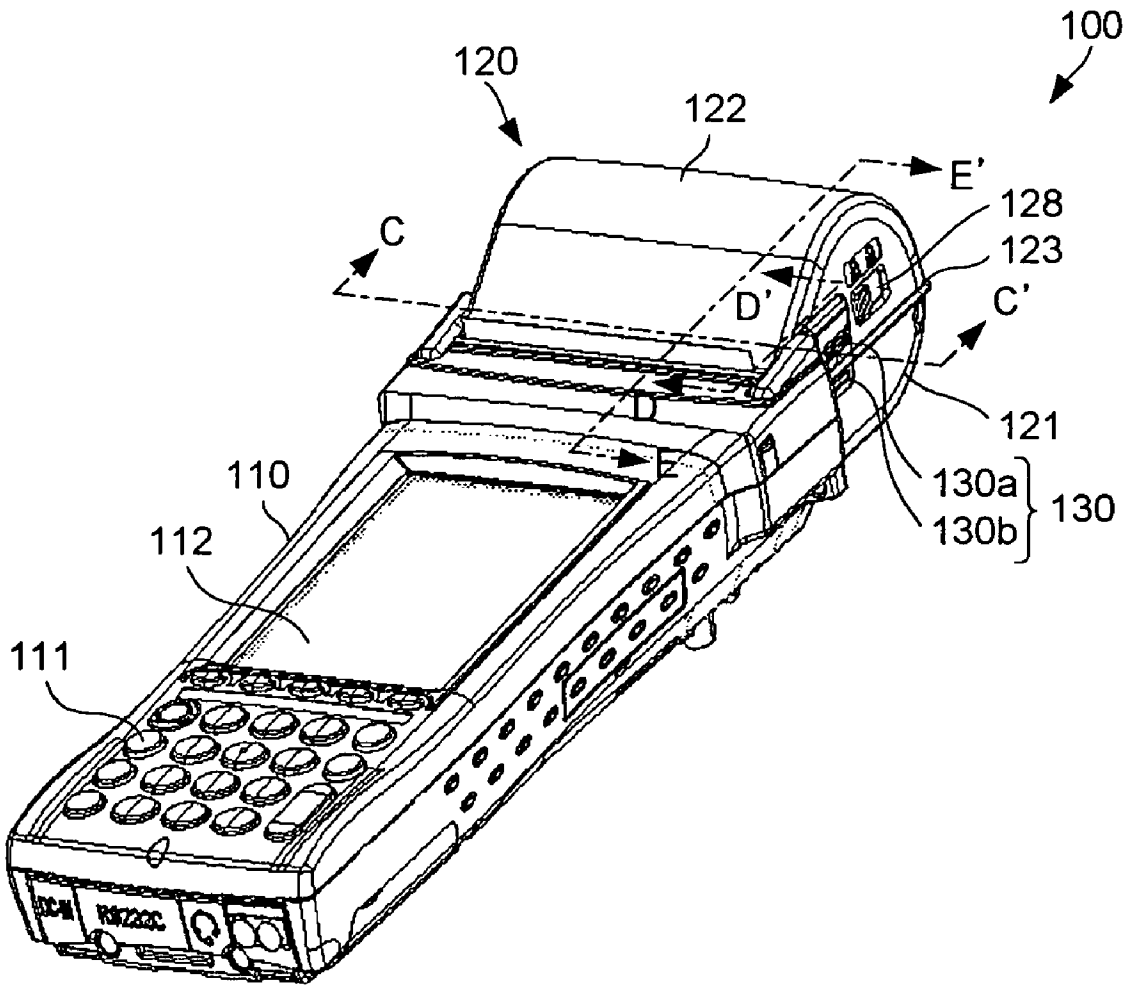
FIG. 1 is a partially cut perspective view of the printer according to an embodiment of the present invention.
Figure 2:
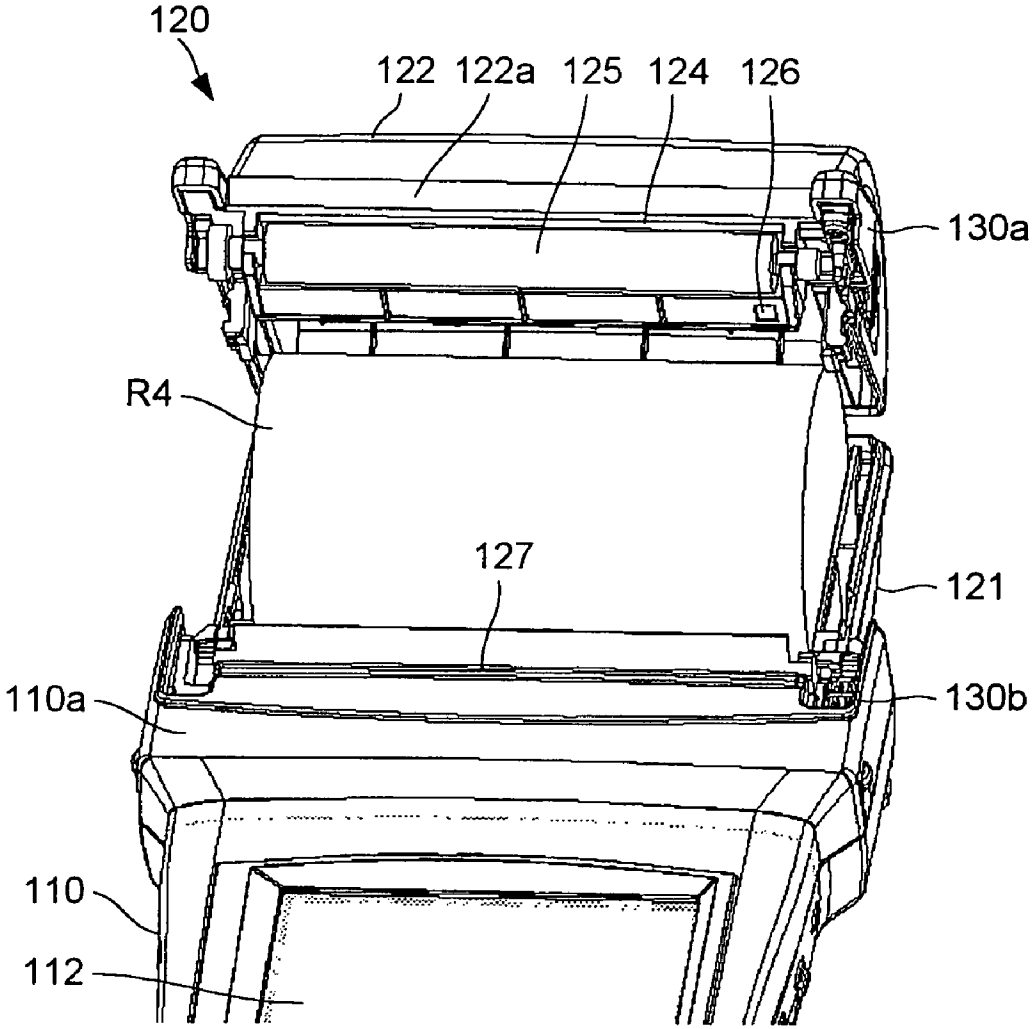
FIG. 2 is a perspective view of a printer unit with a roll paper set.
Figure 3:
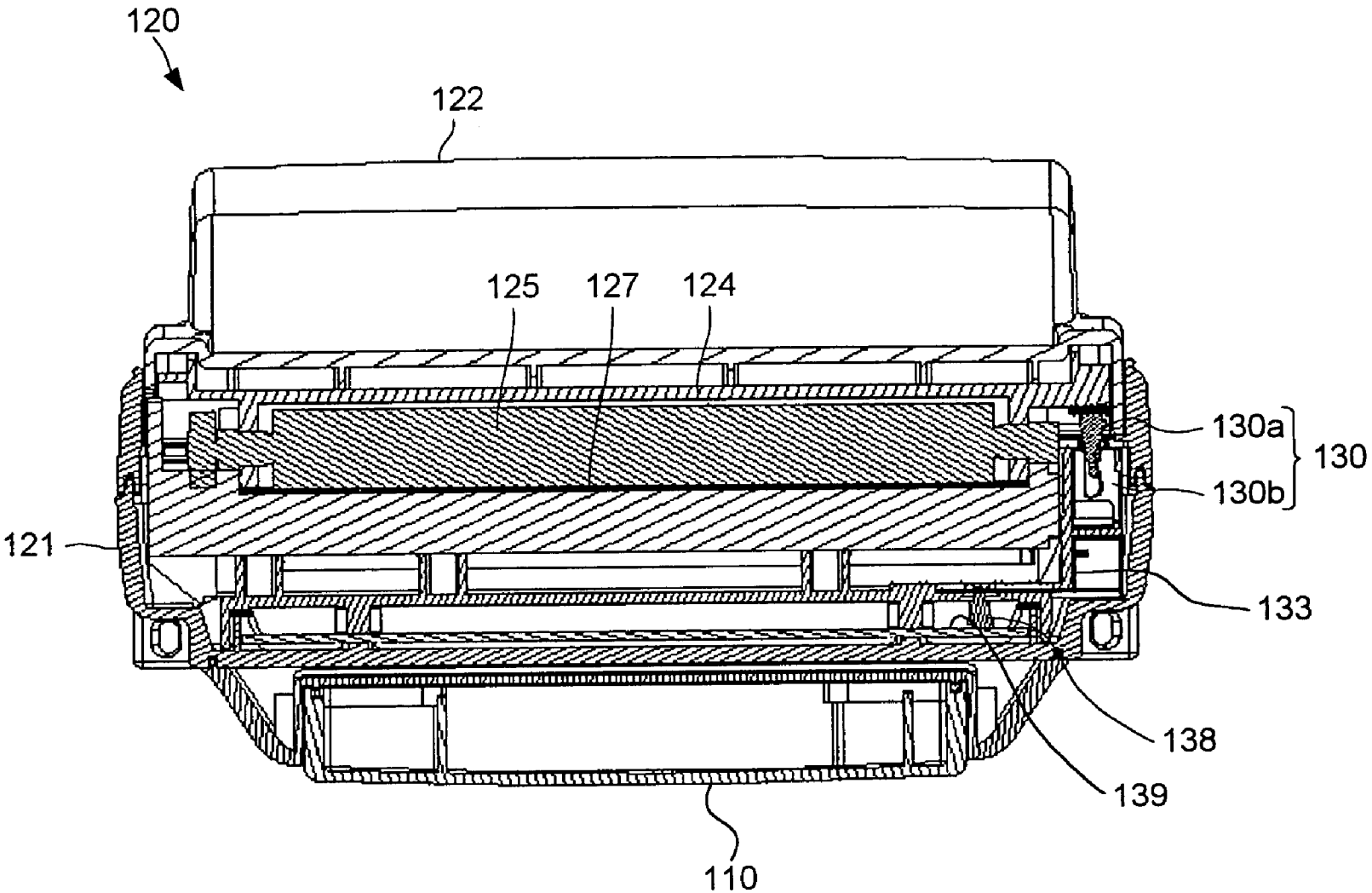
FIG. 3 is a cross sectional view along a line C–C' shown in FIG. 1.
Figure 4:
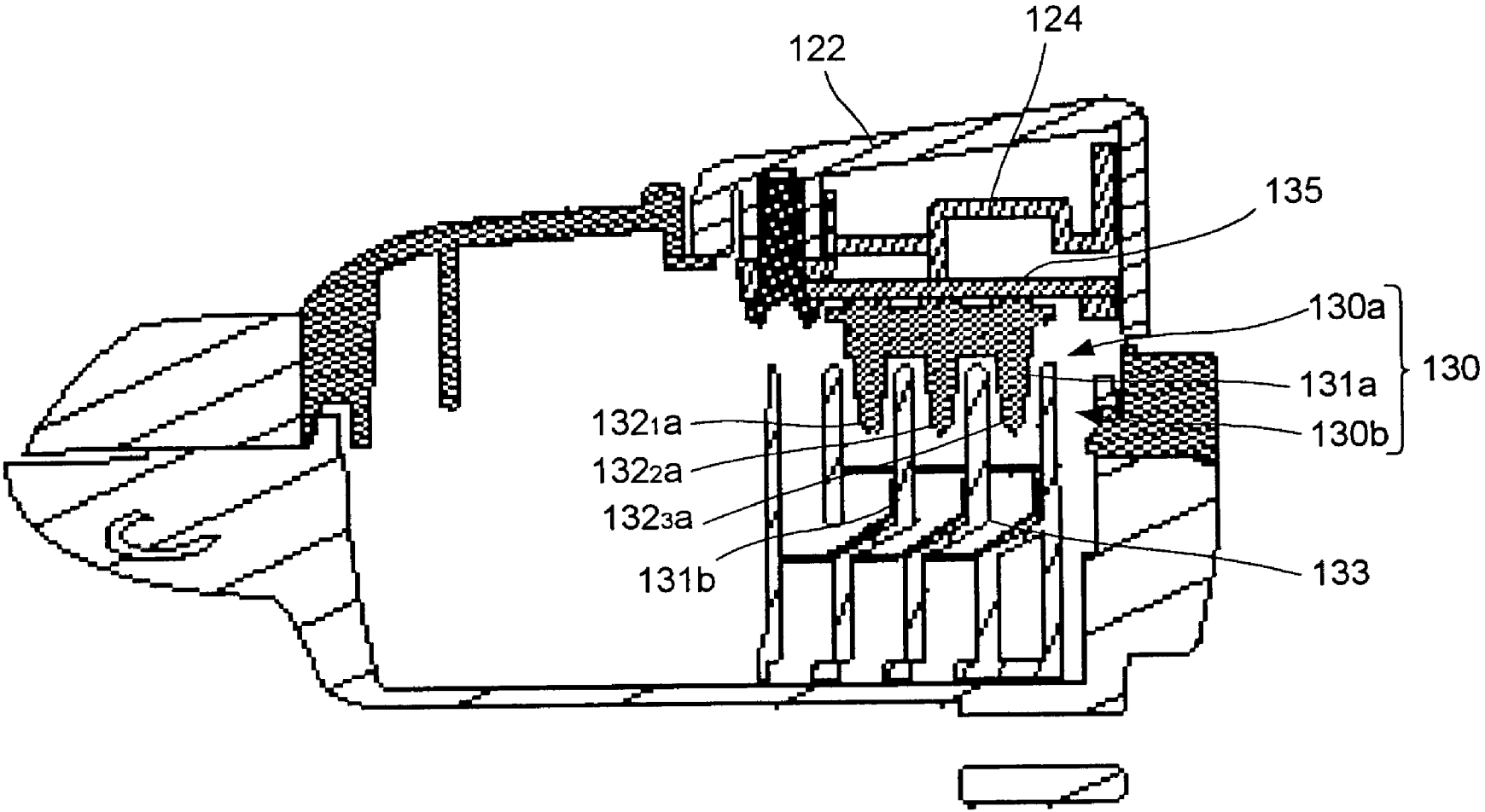
FIG. 4 is a cross sectional view along a line D–D' shown in FIG. 1.
Figure 5A:
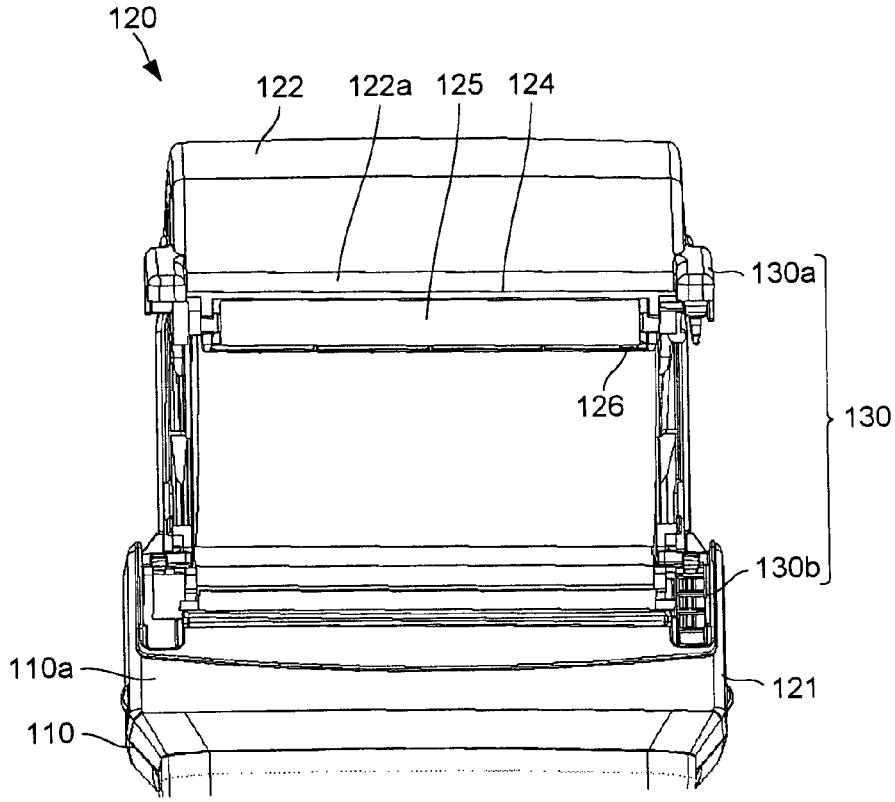
FIG. 5A shows a state in which the printer unit is open.
Figure 5B:
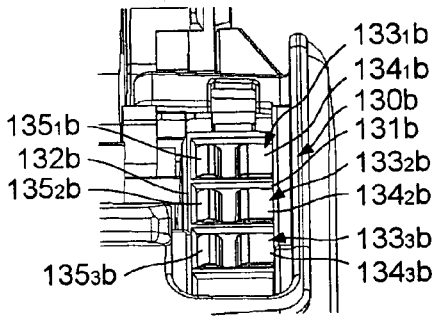
FIG. 5B is an enlarged view of a portion near a contact unit 130*b*.
Figure 5C:
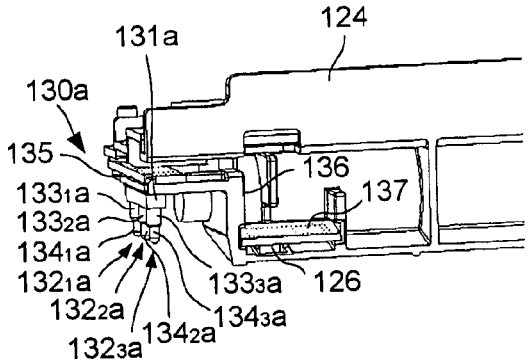
FIG. 5C is an enlarged view of a portion near a contact unit 130*a;*
Figure 6:
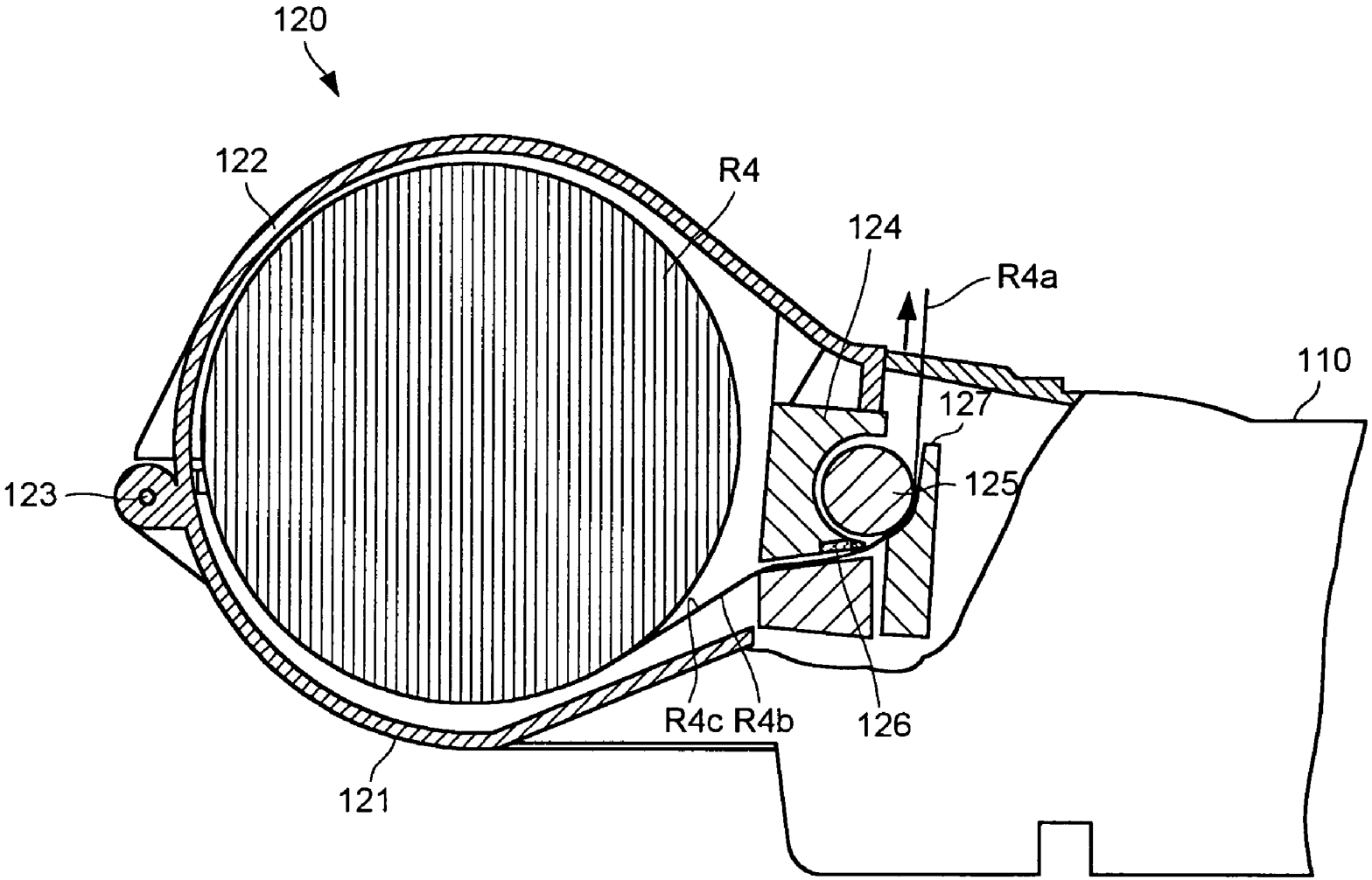
FIG. 6 is a cross sectional view along a line E–E' shown in FIG. 1.
Figure 7:
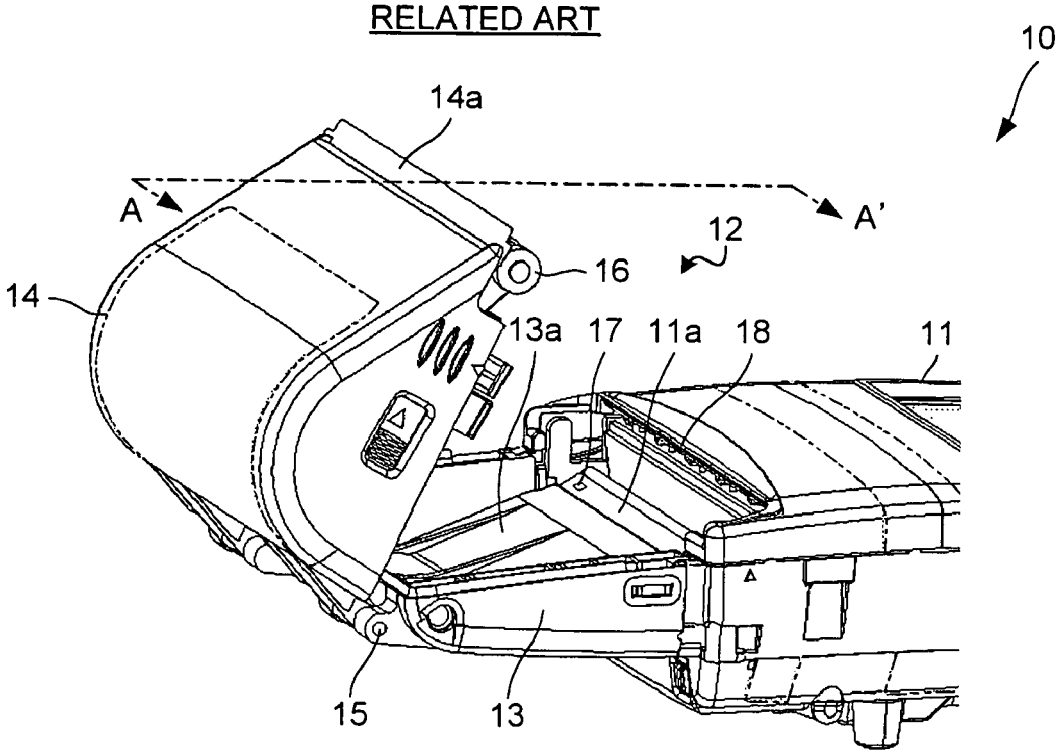
FIG.7 RELATED ART
FIG. 7 is a partially cut perspective view of a conventional printer.
Figure 8:
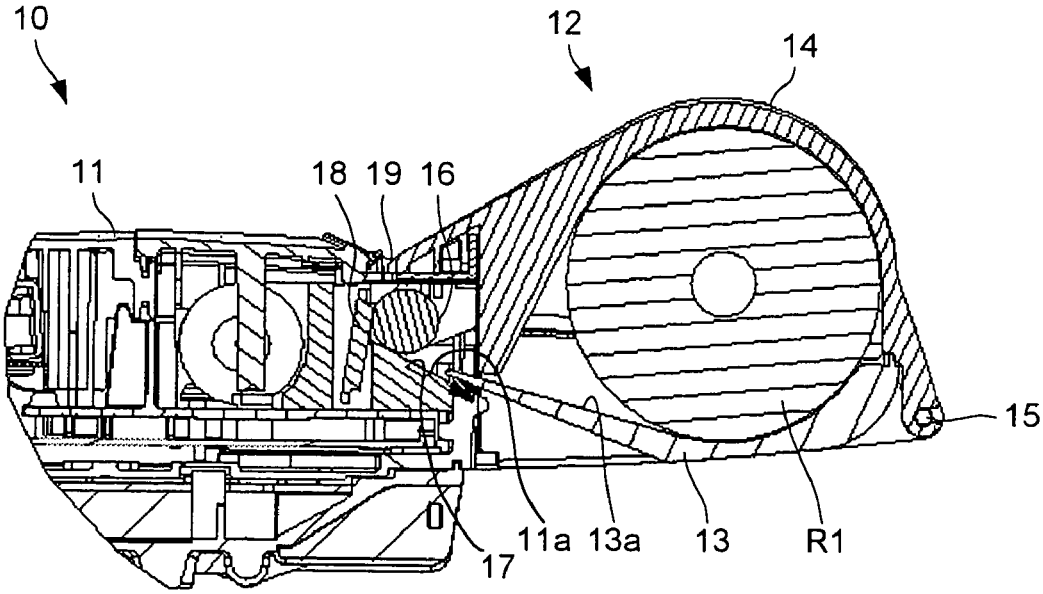
FIG.8 RELATED ART
FIG. 8 is a cross sectional view along a line A–A' shown in FIG. 7.
Figure 9:
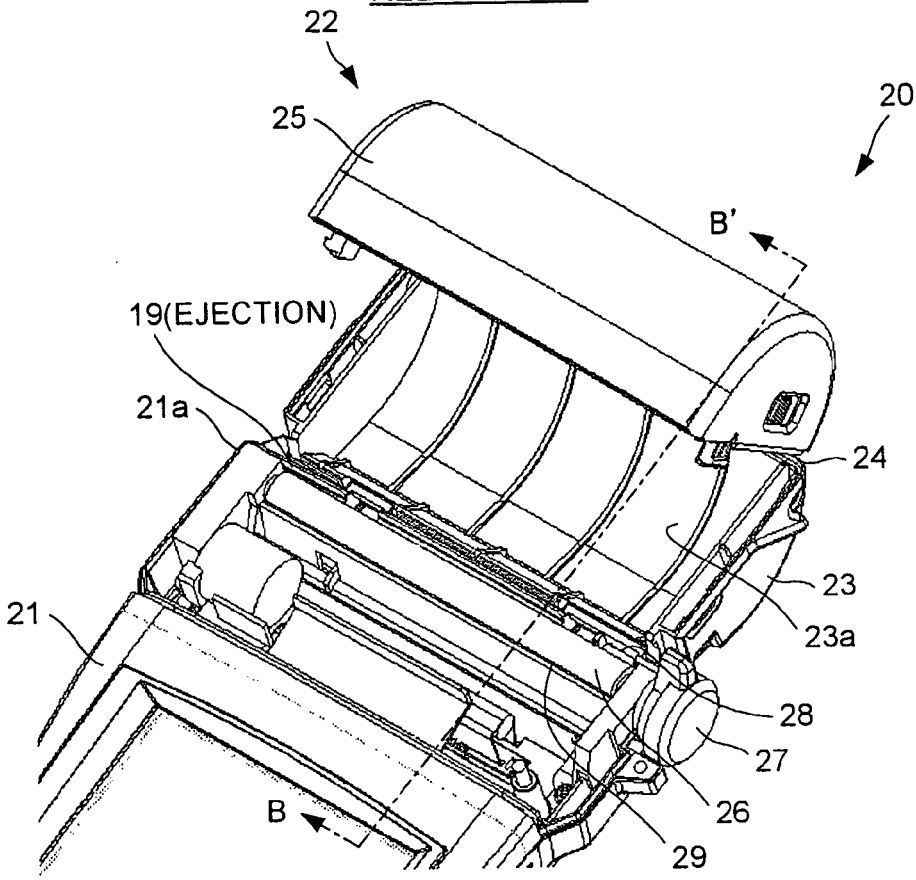
FIG.9 RELATED ART
FIG. 9 is a partially cut perspective view of another conventional printer.
Figure 10:
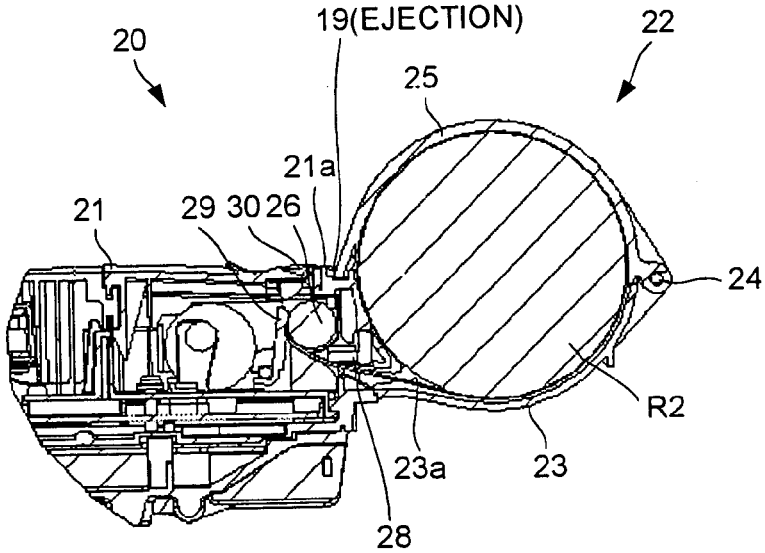
FIG.10 RELATED ART
FIG. 10 is a cross sectional view along a line B–B' shown in FIG. 9.

FIG. 1 is a perspective view of the external configuration of the printer 100 according to an exemplary embodiment of the present invention. FIG. 2 is a perspective view of a printer unit 120 of the printer 100 and shows that a roll paper R4 is set in the printer unit 120. FIG. 3 is a cross sectional view along the line C–C' shown in FIG. 1. FIG. 4 is a cross sectional view along the line D–D' shown in FIG. 1. FIG. 5A shows a state in which the printer unit is open, FIG. 5B is an enlarged view of a portion near a contact unit 130*b*, and FIG. 5C is an enlarged view of a portion near a contact unit 130*a*. FIG. 6 is a cross sectional view along the line E–E' shown in FIG. 1.

The printer 100 is used as a handy terminal. For example, the printer 100 has the function of printing information relating to electricity bills, product sales, or the like on a roll paper. As shown in FIG. 3, the printer 100 has a main body 110 that houses a main printer substrate 139 (see FIG. 3). This main printer substrate 139 holds a control unit (not shown) that controls the printing process. The main body 110 is provided with a key input unit 111 and a display unit 112.

As shown in FIG. 2, the main body 110 has a clam-type printer unit 120 provided at one end 110*a* thereof. The printer unit 120 has a lower cover 121 and an upper cover 122. The lower cover 121 and the upper cover 122 are joined at a joint 123 so that the upper cover 122 can be freely opened and closed.

As shown in FIG. 6, a roll paper R4 is loaded in the space between the lower cover 121 and the upper cover 122, when the upper cover 122 is closed. The roll paper R4 is ribbon-shaped thermal paper and it is wound around a shaft. One end of the roll paper R4 is R4*a*, the printable surface is R4*b* and the non-printable surface is R4*c*.

Marks are printed beforehand at predetermined interval near at least one of the longitudinal borders of the roll paper R4 on the non-printable surface R4*c*. These marks correspond to the printing start position and the printing end position.

FIG. 2 shows the state when the printer unit 120 is open. As shown in FIG. 2, the upper outer cover 122 is provided with a platen roller holder 124 at an end 122*a* thereof. The platen roller holder 124 holds a platen roller 125 such that the platen roller 49 can rotate freely. The platen roller holder 124 is detachably attached to the upper outer cover 122.

When printing, the platen roller 125 sequentially transfers the roll paper R4 that is held between the thermal head 127 for a distance equivalent to one line. The platen roller 125 is driven by a motor (not shown) by means of a gear (not shown).

The platen roller holder 124 is provided with a mark detecting sensor 126 near the platen roller 125. The mark detecting sensor 126 comprises a light emitting element and a light receiving element. As shown in FIG. 6, the mark detecting sensor 126 detects the marks printed on the non-printable surface R4*c* of the roll paper R4.

The light emitting element of the mark detecting sensor 126 emits an infrared light or the like to the non-printable surface R4*c*. The mark detecting sensor 126 detects the marks based on the amount of light received by the light receiving element. The mark detecting sensor 126 is connected to the control unit (not shown) through a contact unit 130 shown in FIG. 1.

The main body 110 is provided with a thermal head 127 attached to the end 110*a* thereof, such that the thermal head 127 faces the platen roller 125. As shown in FIG. 6, when the upper outer cover 122 is closed, the thermal head 127 is pressed against the platen roller 125 with the roll paper R4 sandwiched therebetween.

The thermal head 127 has a number of heating elements arranged along it length. These heating elements print dots in one line on the roll paper R4. The thermal head 127 prints data in the form of dots on the printable surface R4*b* of the roll paper R4 by applying heat to the roll paper R4.

A locking unit 128 shown in FIG. 1, serves to lock the printer unit 120 when the upper cover 122 is closed. The contact unit 130 consists of a convex unit 130*a* and a concave unit 130*b*. The convex unit 130*a* is located on the upper cover 122 and the concave unit 130*b* located on the lower cover 121.

As shown in FIG. 3, the convex unit 130*a* and the concave unit 130*b* fit into each other when the upper cover 122 is closed. The contact unit 130 has the function of electrically connecting the mark detecting sensor to the control unit through a read board 133, a contact pin unit 138, and a main print substrate 139.

As shown in FIG. 5A, the convex unit 130*a* and the concave unit 130*b* are not in contact with each other, when the upper cover 122 is open. As shown in FIG. 5C, the convex unit 130*a* is located at one end of the platen holder 124. The convex unit 130*a* has three connection pins $\mathbf{132}_1a$ to $\mathbf{132}_3a$ that are fixed at predetermined positions. As shown in FIG. 4, a connection pin unit 131*a* is suspended from the print substrate 135 that is fixed to the platen roller holder 124.

The connection pin $\mathbf{132}_1a$ comprises of a large member $\mathbf{133}_1a$ and a small member $\mathbf{134}_1a$ (see FIG. 5C). The end of the large member $\mathbf{133}_1a$ is attached to the small member $\mathbf{134}_1a$ through a spring. Therefore, the small member $\mathbf{134}_1a$ moves freely along with the movement of the spring.

The connection pin $\mathbf{132}_2a$ has the same configuration as that of the connection pin 132, a. The connection pin $\mathbf{132}_2a$ comprises of a large member $\mathbf{133}_2a$ and a small member $\mathbf{134}_2a$. In the same manner, the connection pin $\mathbf{132}_3a$ also has the same configuration as that of the connection pin unit $\mathbf{132}_1a$ and comprises of a large member $\mathbf{133}_3a$ and a small member $\mathbf{134}_3a$.

The print substrate 137 is fixed inside the platen roller holder 124. As shown in FIGS. 2 and 5A, the mark detecting sensor 126 is provided on the print substrate 137. The mark detecting sensor 126 is electrically connected to the connection pin unit 131*a* through a read wire 136 which is located in the platen roller holder 124.

As shown in FIG. 5A, the concave unit 130*b* is located on the lower cover 121. This concave unit 130*b* corresponds to the position of the convex unit 130*a* and fits into the convex unit 130*a* when the printer unit 120 is closed.

As shown in FIG. 5B, the concave unit 130*b* has a connection pin unit 131*b* that further has a framework of three holes that correspond to three connection pins $\mathbf{132}_1a$ to $\mathbf{132}_3a$ (Refer FIG. 5C). A packing 132*b* is a waterproof component that is located in the periphery of the connection pin unit 131*b*. The packing 132*b* prevents the passage of water from the conducting area when the convex unit 130*a* fits into the concave unit 130*b*. The conducting area is the area of contact between the convex unit 130*a* and the concave unit 130*b*.

The three holes of the connection pin unit 131*b* are provided with three elastic connecting springs $\mathbf{133}_1b$ to $\mathbf{133}_3b$. On either side of the connecting spring $\mathbf{133}_1b$ are two connecting members $\mathbf{134}_1b$ and $\mathbf{135}_1b$. The connection pin $\mathbf{132}_1a$ fits into the connecting spring $\mathbf{133}_1b$. In other words, the connecting spring $\mathbf{133}_1b$ holds the connection pin $\mathbf{132}_1a$ through the connecting members $\mathbf{134}_1b$ and $\mathbf{135}_1b$.

The gap between the connecting members $\mathbf{134}_1b$ and $\mathbf{135}_1b$ is normally smaller than the size of the large member $\mathbf{133}_1a$ of the connection pin $\mathbf{132}_1a$. However, this gap can be altered by the elastic force of the connecting spring $\mathbf{133}_1b$. Therefore, when the connection pin $\mathbf{132}_1a$ is fitted to the connecting spring $\mathbf{133}_1b$, the outer limit of the connecting members $\mathbf{134}_1b$ and $\mathbf{135}_1b$ can be pushed further by means of the large member $\mathbf{133}_1a$.

The construction of a connecting spring $\mathbf{133}_2b$ is similar to the connecting spring $\mathbf{133}_1b$. The elastic connecting spring $\mathbf{133}_2b$ has two connecting members $\mathbf{134}_2b$ and $\mathbf{135}_2b$ placed in opposite directions. The connecting spring $\mathbf{133}_2b$ is fitted to the connection pin $\mathbf{132}_2a$.

The construction of a connecting spring $\mathbf{133}_3b$ is similar to the connecting spring $\mathbf{133}_1b$. The elastic connecting spring $\mathbf{133}_1b$ has two connecting members $\mathbf{134}_3b$ and $\mathbf{135}_3b$ on either sides and the connection pin $\mathbf{132}_3a$ is fitted to the connecting spring $\mathbf{133}_3b$.

The connecting springs $\mathbf{133}_1b$ to $\mathbf{133}_3b$ are electrically connected to a read board 133, shown in FIG. 3, having substantially L-shaped cross section. The main body 110 houses a main print substrate 139. The main print substrate 139 further has the control unit (not shown) and the contact pin unit 138.

The contact pin unit 138 has the same configuration as that of the connection pin unit 131*a* shown in FIG. 5C. The read board 133 is electrically connected to the main print substrate 139 based on the connection between the read board 133 and the end of the contact pin unit 138.

As shown in FIG. 2, while loading the roll paper R4 in the printer unit 120, the roll paper R4 is placed inside the lower cover 121, when the upper cover 122 is open.

The end R4*a* of the roll paper R4 extends from the lower cover 121 shown in FIG. 6 to the thermal head 127. When the upper cover 122 is closed, the platen roller 125 is in contact with the thermal head 127 with the roll paper R4 sandwiched therebetween. The end R4*a* protrudes beyond an opening from where the roll paper R4 is ejected out of the printer unit 120. In this state, the mark detecting sensor 126 is in contact with the non-printable surface R4*c* of the roll paper R4.

As shown in FIG. 5A, when the upper cover 122 is closed, the connection pins $\mathbf{132}_1a$ to $\mathbf{132}_3a$ of the convex unit 130*a* fits into the connecting springs $\mathbf{133}_1b$ to $\mathbf{133}_3b$ of the concave unit 130*b*.

The mark detecting sensor 126 is thus electrically connected to the control unit through the print substrate 137, the read wire 136, the convex unit 130*a*, the concave unit 130*b*, the read board 133, the contact pin unit 138, and the main print substrate 139 shown in FIG. 3.

When printing, the control unit drives the motor and rotates the platen roller 125 for a distance equivalent to one line. As a result, the roll paper R4, of length equivalent to one line, is sequentially ejected out of the printer unit 120.

When the mark detecting sensor 126 detects a mark on the non-printable surface R4*c* of the roll paper R4, it informs the control unit of the detection of the mark. The control unit identifies the position of the mark as the printing start position and instructs the thermal head 127 to print data on the printable surface R4*b* of the roll paper R4.

When the mark detecting sensor 126 detects the next mark, it informs the control unit of the detection of the mark. The control unit identifies the position of the mark as the printing end position and stops the motor to thereby stop the rotation of the platen roller 125. In this manner, the data is printed on the printable surface R4*b* between the marks.

The detailed explanation of the present invention has been given with reference to the accompanying drawings. Any change in design that does not deviate from the abstract of the present invention may be included, apart from the embodiment of the present invention.

For example, the contact unit 130 shown in FIG. 3 is explained as an unit that electrically connects the components of the printer. However, the contact unit 130 may also play a role in detecting the opening and closing of the upper cover 121.

In this case, when the control unit is not able to recognize the mark detecting sensor 126, it will mean that the printer unit 120 is open because the contact unit 130 is non-conducting. On the other hand, when the control unit is able to recognize the mark detecting sensor 126, it will mean that the printer unit 120 is closed because the contact unit 130 is conducting.

The printer 100 may have a configuration where the control unit identifies the presence of the roll paper R4 based on the result of detection marks by the mark detecting sensor 126. In other words, when the mark detecting sensor 126 does not detect the mark for more than a predetermined time, the control unit recognizes that there is no roll paper R4 in the printer unit 120, irrespective of whether the platen roller 125 is rotating or not.

The printer 100 may have a lock sensor, which detects the state of the locking unit 128, in the lower cover 122. This lock sensor may be made to informed the locked/unlocked state of the printer unit 120 to the control unit through the contact unit 130.

Further, in the printer 100, a concave unit may be provided at the position of the convex unit 130*a* and a convex unit may be provided at the position of the concave unit 130*b*.

Figure 11:
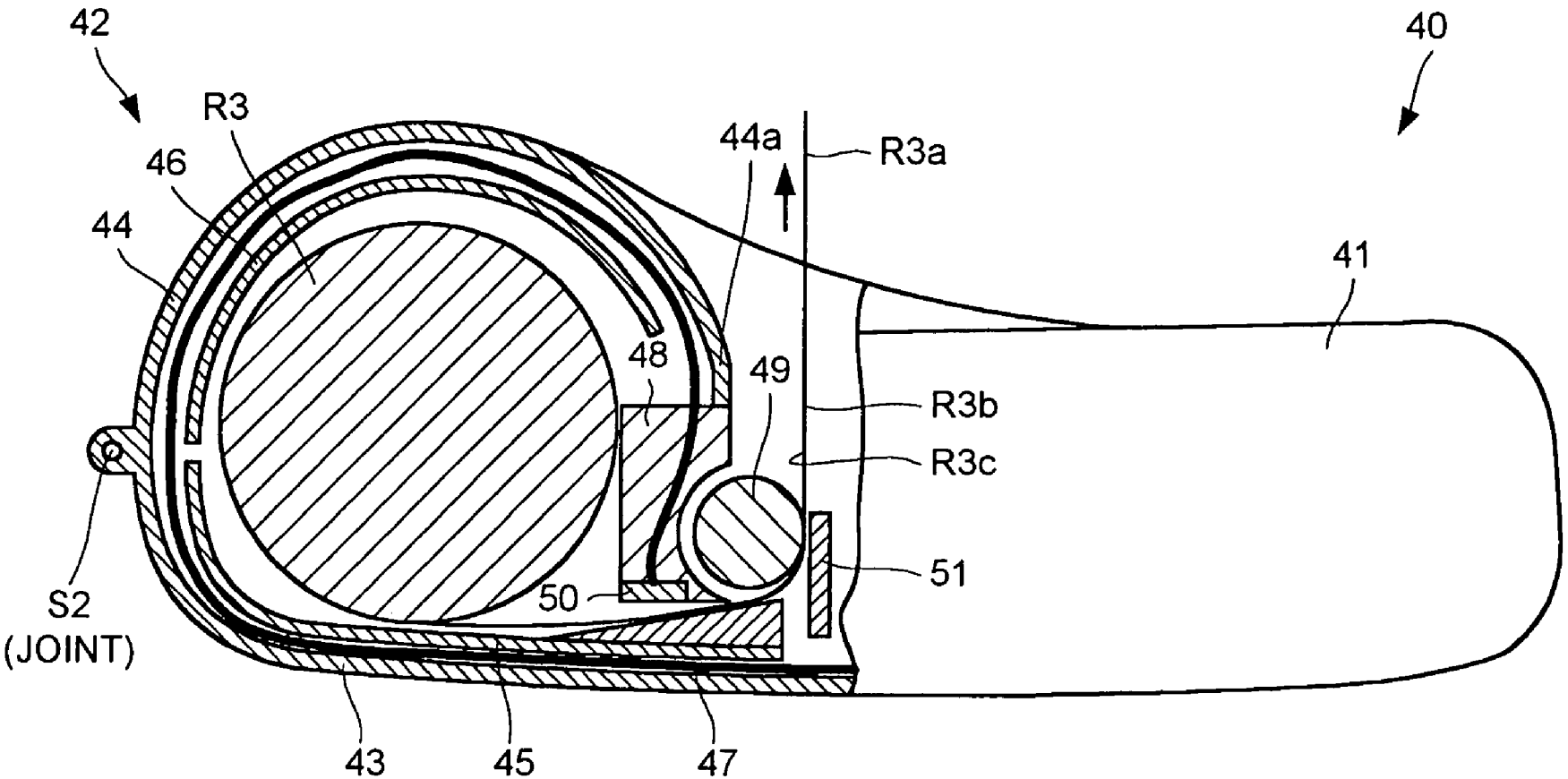
FIG.11 RELATED ART
FIG. 11 shows the cross sectional side view of still another conventional printer.

According to embodiment of the present invention, the convex unit 130*a* and the concave unit 130*b* are provided on the upper cover 122 and the lower cover 121, respectively. When the upper cover 122 and the lower cover 121 are closed, the mark detecting sensor 126 is connected to the control unit through the convex unit 130*a* and the concave unit 130*b*. Hence, the printer of the present invention is less expensive and reliable since the cable 47 is not required as in the case of the conventional printer 40 shown in FIG. 11.

According to the embodiment of the present invention, since the convex unit 130*a* and the concave unit 130*b* have the configuration such that they fit into each other, any unnecessary contact between the components of the printer are reduced and the printer becomes more reliable.

According to the embodiment of the present invention, as shown in FIG. 5B, since a configuration such that the concave unit 130*b* is clipped is provided, non-contact is prevented and the printer becomes more reliable.

According to the embodiment of the present invention, it is possible to easily load the roll paper R4, since the platen roller 125 is arranged on the upper cover 121 and the thermal head 127 is fit into the main body 110.

According to the embodiment of the present invention, it is possible to reduce the human effort for assembling, in comparison with the excessive human effort required for assembling the connecting read wire. This is made possible by providing the contact pin unit 138 for connecting the points between the concave unit 130*b* and the control unit.

According to the embodiment of the present invention, it is possible to perform a less expensive and highly reliable operation by controlling the position of the roll paper R4, based on the detection of the mark detecting sensor 126.

According to the embodiment of the present invention, it is possible to perform a less expensive and highly reliable operation by determining the presence of the roll paper R4, based on the detection of the mark detecting sensor 126.

According to the embodiment of the present invention, it is possible to identify the locked state of the printer in a less expensive and highly reliable manner. The locked state of the printer can be easily identified by locking the upper cover 122 and the lower cover 121 and providing the locking unit 128 that electrically connects to the convex unit 130*a*.

According to the present invention, a first contact unit and a second contact unit are provided on the first cover and the second cover, respectively. When the first cover and the second cover are closed, the mark detecting sensor is connected to the control unit through the first contact unit and the second contact unit. Hence, a cable used in the conventional printer is not required and a less expensive and highly reliable printer is obtained.

According to the present invention, as the first contact unit and the second contact unit have the configuration such that they fit into each other, any unnecessary contact between the components of the printer can be reduced and a highly reliable printer is obtained.

According to the present invention, since the first contact unit or the second unit has the configuration for holding the other contact unit, loose contact can be reduced and a highly reliable printer is obtained.

According to the present invention, since the platen roller is located on the first cover and the printing head is located on the main body, the paper can be easily loaded.

According to the present invention, since a third contact unit is provided for connecting the second contact unit and the control unit, it is possible to reduce the human effort required for assembling the printer.

According to the present invention, it is possible to perform a less expensive and highly reliable operation by controlling the position of the roll paper, based on the detection of the mark detecting sensor.

According to the present invention, it is possible to perform a less expensive and highly reliable operation by determining the presence of the roll paper, based on the detection of the mark detecting sensor.

According to the present invention, it is possible to identify the locked state of the printer in a less expensive and highly reliable manner by providing a locking unit that electrically connects to the first contact unit. The locking unit also serves to lock the first cover and the second cover.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A printer comprising:

a main body;

a printer unit fixed to the main body, the printer unit having a first cover and a second cover, the second cover being attached to the main body, the first cover being fixed to the second cover with a hinge such that the first cover rotates freely along the hinge, wherein a hollow space is created between the first cover and the second cover when the first cover is closed against the second cover, the hollow space being suitable for loading a printing paper having a printable surface and a non-printable surface into the space between the first cover and the second cover, the non-printable surface of the printing paper having at least one mark;

a mark detecting unit provided in the first cover and that detects the mark on the non-printable surface of the printing paper;

a first contact member provided in the first cover;

a second contact member provided in the second cover that makes physical contact with the first contact member when the first cover is closed over the second cover; and a control unit provided in the main body and that is electrically connected to the mark detection unit through the first and the second contact members and that controls various operations of the printer.

2. The printer according to claim 1, wherein the first contact unit and the second contact unit have a construction such that the contact units fit into each other.

3. The printer according to claim 2, wherein the first contact unit or the second unit has a construction such that that particular contact unit can hold the other contact unit.

4. The printer according to claims 1, further comprising:

a platen roller provided in the first cover; and a printing head provided in the main body.

5. The printer according to claim 1, further comprising a third contact unit that connects the second contact unit and the control unit.

6. The printer according to claim 1, wherein the control unit controls a position of the printing paper based on the detection of the mark in the mark detecting unit.

7. The printer according to claim 1, wherein the control unit detects a presence or an absence of the printing paper based on the detection of the mark in the mark detecting unit.

8. The printer according to claim 1, further comprising a locking member that is located on the first cover, wherein the locking member locks the first cover and the second cover and is electrically connected to the first contact unit.

9. The printer according to claim 1, wherein the second cover is detachably attached to the main body.

10. The printer according to claim 1, wherein the first contact member and the second contact member are made of electrically conducting material.

11. The printer according to claim 1, further comprising a printing head provided in the second cover.

12. The printer according to claim 1, wherein the printing head is a thermal head.

13. The printer according to claim 1, wherein the non-printable surface of the printing paper has a plurality of marks, and the control unit instructs to start the printing when the mark detecting unit detects a mark and, the control unit instructs to stop the printing when the mark detecting unit detects another mark.

* * * * *